United States Patent [19]

Clark

[11] 4,130,911

[45] Dec. 26, 1978

[54] STREET BRUSH

[76] Inventor: Gaylord J. Clark, 4769 Paw Paw Lake Rd., Coloma, Mich. 49038

[21] Appl. No.: 798,998

[22] Filed: May 20, 1977

[51] Int. Cl.[2] ..... A46B 13/02

[52] U.S. Cl. ..... 15/179; 15/182; 29/123

[58] Field of Search ..... 15/179, 181, 182, 183, 15/53 A, 53 AB, 82, 83, 49 C, 50 C, 77; 29/117, 123, 124, 125

[56] References Cited

U.S. PATENT DOCUMENTS

| | | | |
|---|---|---|---|
| 3,074,288 | 1/1963 | Newton | 29/123 X |
| 3,340,558 | 9/1967 | Tamny | 15/182 |
| 3,584,328 | 6/1971 | Lechene et al. | 15/179 |
| 3,763,516 | 10/1973 | Welter | 15/182 |

FOREIGN PATENT DOCUMENTS

| | | | |
|---|---|---|---|
| 23778 of | 1894 | United Kingdom | 15/179 |

*Primary Examiner*—Peter Feldman

*Attorney, Agent, or Firm*—Blanchard, Flynn, Thiel, Boutell & Tanis

[57] ABSTRACT

Mounting means for a rotary brush. Mounting means are provided for a rotary brush, such as is used in streat cleaning equipment or in a car wash, wherein stub shafts are arranged in connection with a brush core for mounting the brush onto suitable support and driving means. The mounting means provides firm and rigid support together with positive protection for the end of the brush when assembled into operative position and can be quickly removed for replacement of the brush portion as desired. In the preferred embodiment, a plate is rigidly fixed coaxially within a brush core and a generallyhat-shaped fitting is placed against each end, the crown portion of such fitting being received into the core of the brush and bearing against said plate and the brim portion thereof lying against an axial end of the brush for protection of same. A stub shaft has a flange fixed thereto and bolts extend through said flange, the crown portion of said hat-shaped fitting and into said plate for holding the assembly together.

2 Claims, 4 Drawing Figures

STREET BRUSH

FIELD OF THE INVENTION

This invention relates to a mounting means for rotary brushes and particularly to a type thereof having a cylindrical core and wherein a stub shaft is rigidly fixed to said core by means including protective means for an end of the brush which is supported on such core and which means can be readily disconnected for facilitating replacement of the brush on the core.

BACKGROUND OF THE INVENTION

While such machines as street cleaning machines or car washing machines have been known for a long time, and the rotary brushes utilized therewith consequently known for an equally long time, there has been a continuing problem in providing suitable means by which such brushes may be mounted onto the driving and support mechanism therefor.

In the past, such mounting means have frequently included a shaft passing all of the way through the brush with obvious, substantial increase in the weight of the assembly, as distinquished from one utilizing only stub shafts at each end, and further involving considerable inconvenience in the removal of such shaft for replacement of a brush.

In an attempt to eliminate the inconveniences of the continuous shaft extending through the brush, attempts have been made to mount stub shafts at each end of a brush. In some instances the devices are strictly mechanical, such as exemplified by U.S. Pat. No. 3,921,245 issued to the present applicant herein which while effective requires a number of accurately machined parts and is therefore expensive.

Other approaches to the problem of mounting for easy removability of the brush have included various kinds of pneumatic or other resilient devices within the brush core for fastening of shaft means thereto. Such are illustrated in both of U.S. Pat. Nos. 3,649,985 and 3,900,913. Here, though through-shafts are utilized in both of these patents, there are shown for easy brush replacement two types of resilient means positioned within the core and effective for expanding radially outwardly to engage the core. These likewise are reasonably effective but they are complex, require the presence of rubber or other resilient parts which tend to weaken in use and for other reasons leave much to be desired.

Accordingly, the objects of the invention include:

1. To provide mounting means for a pair of stub shafts at each respective end of a rotatable brush core, such as for brushes of the type often used in street cleaning or car washing equipment.

2. To provide brush mounting means, as aforesaid, wherein either stub shaft can be conveniently and readily removed independently of the other stub shaft.

3. To provide apparatus, as aforesaid, wherein the stub shaft is applied and removed by simple manipulation of appropriate bolts and without other procedures.

4. To provide apparatus, as aforesaid, wherein said stub shafts can be applied or removed by simple tools.

5. To provide apparatus, as aforesaid, which will be sturdy and reliable and capable of long and satisfactory use.

Other objects and purposes of this invention will be apparent to persons acquainted with brushes of this general type upon reading the following specification and inspecting the accompanying drawings.

DETAILED DESCRIPTION

Figure 1:
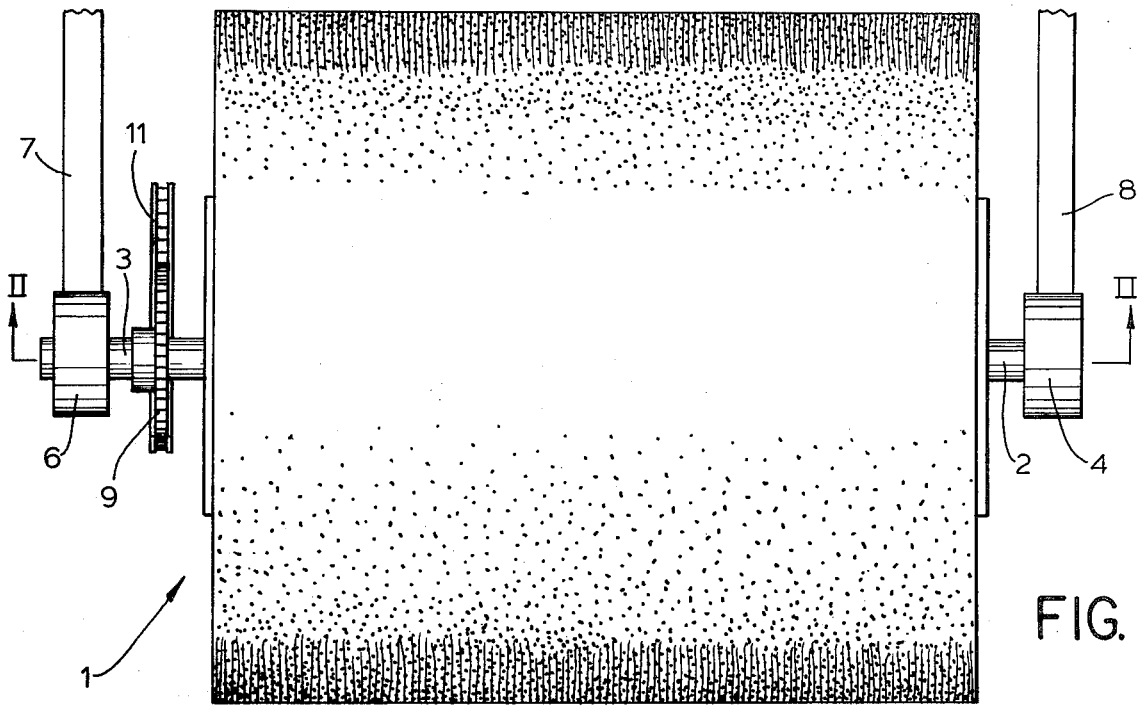
FIG. 1 is a top plan view of a brush embodying the invention attached in a conventional manner to typical radius arms of a street cleaning or car washing machine.

In meeting the objects and purposes above set forth, there is provided a brush assembly 1 mounted on a pair of stub shafts 2 and 3. The stub shafts are received into appropriate bearings 4 and 6, respectively, which in turn are supported on the radius arms 7 and 8 of an otherwise conventional use device, as a street sweeping or car washing machine. The stub shaft 2 in this embodiment also carries a sprocket 9 which is driven by a chain 11 for driving rotatingly the brush 1. All of the foregoing is conventional and needs no further description.

Figure 2:
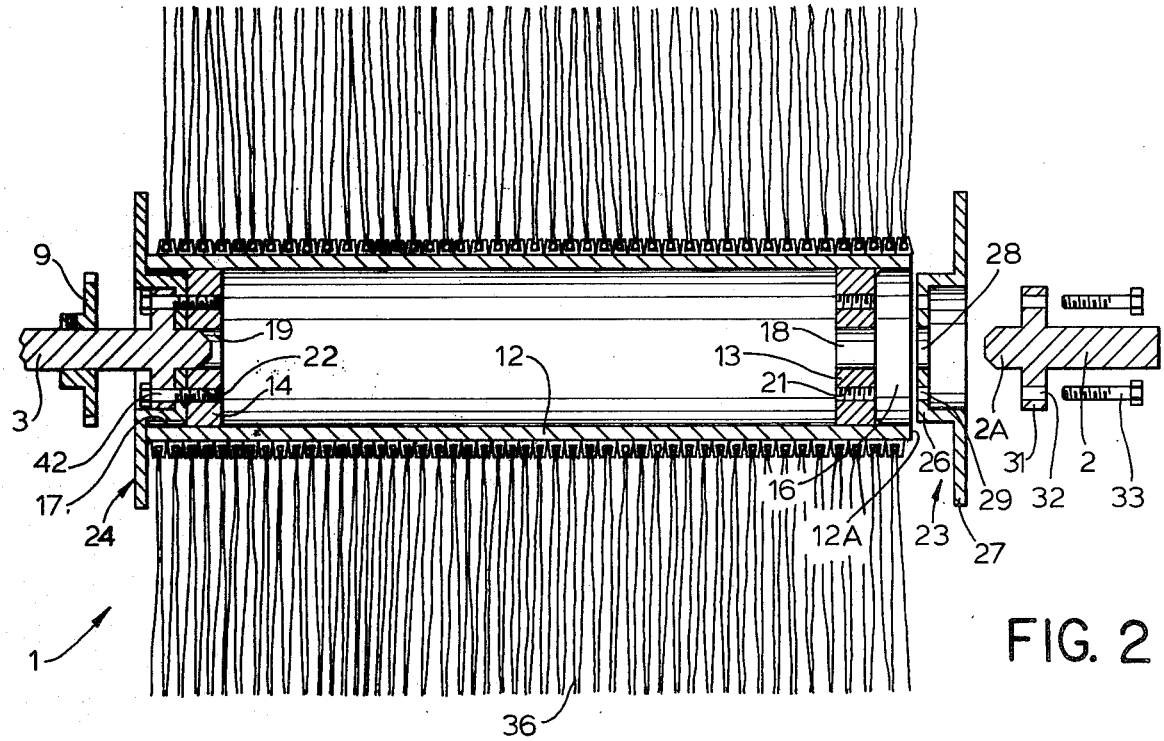
FIG. 2 is a section taken on the line II—II of FIG. 1 showing one end thereof in exploded condition and the other end in assembled condition.
Figure 3:
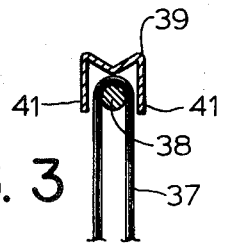
FIGS. 3 and 4 illustrate one typical way of assembling the brush bristles onto the brush core.

Now turning to the details of the brush construction and particularly the manner of mounting the stub shafts therein, attention is directed to FIG. 2. There is here shown a hollow cylindrical roll 12 carrying at each end thereof suitable wall members, here disks 13 and 14, welded rigidly in place, each thereof being spaced back a short distance from the respectively adjacent extremities of the roll 12 to define recesses 16 and 17. Central openings 18 and 19 are provided in each of said disks and are of size to receive snugly the inner ends of respective stubs shafts 2 and 3. A plurality of threaded openings 21 is provided in the disk 13 and a further plurality of such openings 22 is provided in the disk 14.

End plates 23 and 24 are positioned at each end of the roll 12, the assembled position thereof being indicated at the rightward end of FIG. 2. Said end plates are of somewhat hat-shape wherein the crown portion 26 of the hat-shape plate 23 is of such depth and diameter as to fit snugly into the recess 16 and when so positioned the rim portion 27 thereof will bear snugly against the end 12A of the roll 12. The end plate 23 is provided with an opening 28 which is aligned with and the same size as the central opening 18 and it is further provided with a plurality of openings 29 which are of the same size as (or actually a clearance size greater than) and aligned with the threaded openings 21.

The stub shaft 2 has a flange 31 thereon which in this embodiment is formed integrally therewith. Said flange is spaced from the inner (leftward as appearing in FIG. 2) end of said stub shaft to provide an inner projecting portion 2A thereon. When in assembled position, said inner projecting portion 2A projects through both the openings 28 and 18 and fits snugly thereinto, particularly fits snugly into the opening 18. Bolt openings 32 are provided in said flange 31 which openings are positioned in alignment with the openings 29 and 21 and are preferably the same size as the openings 29. Screws 33 are then provided to project through the openings 32 and 29 and into engagement with the threads of openings 21 for holding the assembly together as shown at the rightward end of FIG. 2. The leftward end of the brush is similarly constructed and assembled so that the stub shaft 3 is identical with the stub shaft 2, fits and projects through the end plate 24 and the disk 14 and is similarly held rigidly in position by the screws 42.

The sprocket 9 can be fitted and fixed onto either stub shaft as desired for appropriate cooperation with the rest of the machine.

Figure 4:
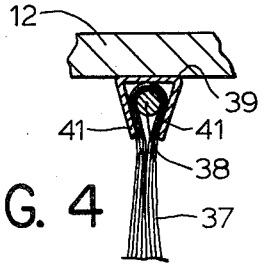

The roll 12 is provided with suitable bristles 36 which may be applied to said roll in any convenient conventional manner. In the particular embodiment shown, the bristles 37 are wrapped around a flexible cord 38 which are received into a channel 39. Said channel 39 is initially of a somewhat shallow M-shape such that when the cord 38 is tightened against the point of the M it will move the tips 41 of the M toward each other and against the bristles 37, thereby forming the construction shown in FIG. 4. The bristles assembly as shown in FIG. 4 is then arranged spirally around the roll 12 to form the brush 36 illustrated in FIG. 2. Such brush assembly is, however, conventional, will be understood by those skilled in the art without further description or illustration and may be freely replaced by any other desired and appropriate bristle fixing arrangement.

It will be observed by inspection of FIG. 2 that with the arrangement shown, the stub shafts may be readily removed by the simple removal of the screws 33 and 42 for easy and convenient replacement of the roll 12 and brush 36 carried thereby as desired. However, when assembled, it will be recognized that the reception of the projecting portion 2A into a relatively long but snugly fitting opening 18 together with the fitting of the flange 31 against the crown portion 26 of the end plate will hold said stub shaft 2 firmly and rigidly in position when the screws 33 are properly tightened. At the same time, the rim portion 27 will protect the adjacent end of the brush 36 from physical damage such as, in the case of the use of the brush on a street sweeping machine, contact with obstructions such as a curbing. Stub shaft 3 is similarly held rigidly in position as shown and the rim of the end member 24 similarly protects the leftward end of the brush 36. While ideally the axial dimension of the crown portion 26 should be exactly equal to the axial dimension of the recess 16 in order that the bottom of said crown portion should bear snugly against the wall member, here the disk 13, while the rim portion 27 bears against the end 12A of the roll, with usual manufacturing tolerances this will not normally be practicable. However, the dimensions may vary in either direction without harm to the final product inasmuch as a firm construction will be obtained either if said crown portion bears snugly against the wall member 13 while the rim portion 27 is slightly spaced from the adjacent end 12A of the roll, or vice versa.

The end member 24 is related to the recess 17 in the same manner as above described for the end member 23 and hence description of this relationship does not need to be repeated.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Mounting means for a cylindrical rotatable brush, such as used in street sweeping or car washing machines, comprising in combination:

an elongated, cylindrical, tubular member for carrying brush bristles and having a central opening extending throughout the length thereof;

a pair of disks positioned within the central opening of said tubular member and rigidly fixed thereto, said disks being positioned adjacent the opposite ends of said tubular member and spaced inwardly a selected distance from the adjacent ends to define a recess at each end of said tubular member which opens axially outwardly thereof, each said disk constituting the bottom wall of one of said recesses;

each said disk having a central shaft opening formed therein and coaxially aligned with the longitudinal axis of said tubular member, each said disk also having a plurality of threaded openings therein, said threaded openings being radially spaced outwardly from said central shaft opening and arranged therearound;

an end plate at each end of said tubular member, each said end plate being hat-shaped and including a cup-shaped crown fitted within a respective one of said recesses, said hat-shaped end plate also including an annular rim which is fixed to the edge of said crown and projects radially outwardly therefrom;

said cup-shaped crown having a base portion which overlies and substantially bears against the respective disk, said base portion having a center opening extending therethrough and generally coincident with the central shaft opening of the respective disk, said base portion also having bolt holes extending therethrough and generally coincident with the threaded openings of the respective disk;

said rim comprising a substantially flat annular plate which projects radially outwardly substantially beyond the outer periphery of said tubular member, said rim being positioned closely adjacent and substantially in snug engagement with the free end of said tubular member as said rim projects radially outwardly therepast;

a stub shaft fixedly but releasably connected to each end of said tubular member and projecting outwardly thereof in substantially coaxial alignment with said longitudinal axis, said stub shaft including an elongated shaft portion having a substantially annular flange rigidly affixed thereto and projecting radially outwardly therefrom intermediate the ends thereof, one end of said shaft portion passing through the center opening of said base portion and the central shaft opening of said disk, and said flange overlying and fitting snugly against the outwardly facing surface of said base portion, said flange also having bolt openings extending therethrough and generally coincident with the bolt openings in said base portion; and a plurality of screws passing through the aligned bolt openings of said flange and said base portion and said disk for fixedly joining said stub shaft, said end plate and said disk together;

whereby each said stub shaft is rigidly held with respect to said tubular member and projects axially outwardly therefrom, said stub shaft being readily disassembled from tubular member by removal of said screws.

2. Mounting means according to claim 1, wherein said disk comprises a flat but rather thick plate having an annular peripheral surface which is disposed closely adjacent and in substantial engagement with the inner peripheral surface of said tubular member, said disk in its entirety being spaced inwardly from the adjacent free end of said tubular member, said end plate comprising a one-piece structure formed from relatively thick platelike material, and said shaft portion having the inner end thereof provided with a cross-section substantially the same as the central shaft opening in said disk so that the inner end of the said shaft portion is snugly received therein.

* * * * *